US005607124A

United States Patent [19]

Earley

[11] Patent Number: 5,607,124

[45] Date of Patent: Mar. 4, 1997

[54] DOWN SPOUT SPACER AND ANCHORING ARRANGEMENT

[76] Inventor: John A. Earley, 26 Dolloff Ave., Beverly, Mass. 01915

[21] Appl. No.: 456,538

[22] Filed: Jun. 1, 1995

[51] Int. Cl.[6] ..... E04D 13/072

[52] U.S. Cl. ..... 248/48.2; 248/48.1

[58] Field of Search ..... 248/48.2, 48.1

[56] References Cited

U.S. PATENT DOCUMENTS

| | | | |
|---|---|---|---|
| 1,639,916 | 8/1927 | Wilson | 248/48.2 |
| 2,004,448 | 6/1935 | Sansonetti | 248/48.1 |
| 2,947,505 | 8/1960 | Sheets | 248/74 |
| 3,363,865 | 1/1968 | Metsker | 248/48.1 |
| 3,388,881 | 6/1968 | Anderson | 248/74 |
| 3,454,249 | 7/1969 | Geisinger | 248/205 |
| 3,588,011 | 6/1971 | Peres | 248/68 |
| 3,752,428 | 8/1973 | Trostle et al. | 248/48.2 |
| 4,601,450 | 6/1986 | Lindquist | 248/71 |
| 4,745,657 | 5/1988 | Faye | 248/48.2 |
| 5,308,253 | 5/1994 | Maki | 248/205.3 |

*Primary Examiner*—Leslie A. Braun
*Assistant Examiner*—Willie Berry, Jr.
*Attorney, Agent, or Firm*—Don Halgren

[57] ABSTRACT

The present invention comprises a molded anchor and spacer arrangement for securement of a down spout to a wall of a house or structure. The anchoring and support arrangement may comprise a block of plastic resin which is molded into a disk like configuration having a first or outer planar surface and a second or inner planar surface with a central bore extending between the first and second planar surfaces. A securement means may be disposed through the central bore to anchor the securement member to the wall. A channel is disposed across the surface of the second planar surface to permit a strap of nylon to be disposed therealong, so as to encircle the support member and a down spout disposed thereagainst.

15 Claims, 2 Drawing Sheets

DOWN SPOUT SPACER AND ANCHORING ARRANGEMENT

BACKGROUND OF THE INVENTION

1. Field of the Invention

This invention relates to spacers for supporting a down spout or the like from the wall of a house.

2. Prior Art

Typical prior art arrangements for attaching a down spout to a wall has consisted of a strap nailed at its ends to the building, the strap surrounding the down spout. Other arrangements for holding such a down spout against a wall might comprise a generally "U" shaped bracket having a wall piercing nail extending therewithin, typically the down spout held to the ends of the arms of the "U" shaped member by twisted wire. Neither of these practices permit the down spout to be adjustably spaced from the wall of the house and they may also have the consequences of rusting, breaking and creating a hole within the wall of the house into which water may seep.

One arrangement for keeping a down spout against a house, is shown in U.S. Pat. No. 4,601,450 to Lindquist. This patent shows a broad strap or collar which is preformed on a bending machine, so as to enwrap a down spout with one side of the sleeve attached to an elongated spike. This is an expensive support which does not offer spacer capabilities, it has the disadvantages of the earlier prior art.

U.S. Pat. No. 3,588,011 to Peres, shows a holder clip for attaching pipes and cables by an injection molded arrangement which is complicated by the extensive tie clip arrangement. U.S. Pat. No. 3,454,249 to Geisinger shows a first pad which is adhesively attachable to a surface that first pad, having a space member under which a wire strap may be interspersed so as to hold a bundle of wires thereabove. There are no means for properly spacing the element tied from the support surface.

U.S. Pat. No. 3,388,881 to Anderson shows a down spout pipe mounting made from a multi-bend sheet metal bracket arranged in conjunction with a wire clip which is mated thereto. This mounting device is complicated to manufacture and fails to show adaptability towards the needs for adjustability in a spout support arrangement. A further complicated metal support for a down spout is shown in U.S. Pat. No. 3,363,865 to Metsker which is a generally "Y" shaped holder having an adjustable strap which is lockable around the outer or distal end of the bracket. This support requires a number of expensive parts which are subject to malfunction and to rust.

A simpler down spout hanger is shown in U.S. Pat. No. 2,947,505 to Sheets wherein an elongated wire is twisted at its midpoint into a figure "8" shape having a pair of arms extending from the middle of the figure "8", which arms are utilized to wrap around the down spout and subsequent tied therearound. This of course does not provide for any spacing arrangement from the wall and it also may provide a danger to the house, from seepage of water through the anchor means which are typically nailed, which nails are exposed to the elements and have a tendency to pull back.

A further complicated down spout fastening arrangement is shown is U.S. Pat. No. 991,192 to Battenfeld. This arrangement utilizes a strap having a clip which is lockable about a down spout. The strap is attached to a formed metal frame, which frame is securable by nails to the wall. This suffers from the similar construction of the above mentioned prior art, wherein the down spout is utilized only a single spaced distance from a wall, in a construction which is complicated, expensive, and subject to breakage and or corrosion.

U.S. Pat. No. 821,833 to Shaffner, shows a simple twisted wire having two ends, each of which are attached by screws, to a wall. The wire has a plurality of twists which define a down spout enshrouding construction. While this arrangement is simple in construction, it is subject however to wear, breakage, and corrosion.

It is an object of the present invention to provide a down spout securement arrangement which is both simple in construction, long lasting in its use, and arranged to be adaptable to multiple positions/dimensions with regard to a wall to which it is to be attached.

It is a further object of the present invention to provide a down spout spacing arrangement which may be readily adjustable to compensate for irregularities in the plane of the wall surface with respect to the plane of the down spout.

BRIEF SUMMARY OF THE INVENTION

The present invention relates to a spacing arrangement for supporting a down spout or pipe from the wall of a building or structure. The spacer arrangement is typically utilized between the down spout and the wall of the building so as to both securely hold it and keep it spaced away from the building in an adjustably controlled manner. The spacer arrangement in its preferred embodiment, comprises a disk shaped member approximately 2½ to 3 inches in diameter. The disk shaped anchor pad member has a central bore through which a securement means may be disposed. Such securement means may preferably comprise a galvanized dry wall screw, a nail, or even adhesive arrangements. The anchor pad has a first or upper planar surface, and a second or lower planar surface. The second surface in one embodiment, is parallel to the first planar surface. In a further embodiment, the second or lower surface is in a non-parallel relationship with the first or upper surface. In such a non-parallel arrangement the thickness of the anchor pad and one diametrical side may be about ⅞ of an inch and the thickness of the other diametrical side is about 9/16 to about ¾ of an inch, thus reflecting a skewness of about 10 to 15 degrees which permits it to be utilized on shingles or clapboards having corresponding skewness. A channel is cut or molded into the lowermost or second planar surface forming a kerf of about ⅛ to 3/16 of an inch wide and deep. This kerf or channel, extends across the entire second planar surface immediately adjacent the central bore extending through the center of the anchor pad.

In another preferred embodiment, the first or upper planar surface may have a plurality of dimple-like projections thereon, spaced at the corners of an imaginary square or spaced diametrically opposed from one another on the upper or first planar surface. The lower or second planar surface would have corresponding holes of a hemispherical or dimple like nature which are in alignment with the dimples on the upper or first surface.

In operation, several pads of different thicknesses may be stacked upon one another. The dimples extending from a first upper planar surface mating with the holes on the lower dimple surface of a second anchor pad, to provide a proper spacing between a down spout and a wall. Additionally, the extra or supplemental pads may have non-skewed or parallel first and second faces, so as to not compound skewness where such non-compounding is desired.

An elongated nylon tie strap, having a loop or receiving opening at one end, and a barbed surface at its other end, may be disposed through the channel or kerf on the second or lowermost planar surface of an anchoring pad. The nylon tie strap may then be brought around the down spout resting against the pad. Such a down spout, may be anchored by threading the barbed end through the open or receiving end to secure them together, the extra or waste end of the strap being cut away.

An assembly of two or more anchor pads of different thicknesses may be utilized to properly space the down spout from a house. In the non-parallel planar face arrangement of an anchor pad, one pad may be utilized to lie against a non-vertical or clapboard type wall on which a down spout is to be placed. By arranging a plurality of anchor pads, each having non-parallel planar surfaces, those anchor pads may be rotated about their common bore opening axis so as to properly define a second or rear surface which mates with a non vertical surface of a wall, while still providing a vertical outermost or first surface onto which a down spout may be secured. In all cases, the spacer pad installer must use a proper securement means such as galvanized screws or masonry insert for correct anchorage.

Thus what has been shown is a unique arrangement for providing an anchoring and spacing means for securing a down spout to a house or wall, wherein that anchoring pad may be arranged in an adjustable manner to fit the non vertical surface of a wall with the vertical surface of a down spout.

The invention thus comprises a down spout anchoring and standoff arrangement for securing a down spout to a structure, comprising: a solid block of plastic material having a first planar surface and a spaced part second planar surface defining the front and back of the anchor member; a generally centrally disposed bore having an anchoring means extending therethrough from the first surface through the second surface for attachment to the wall; and a channel arrangement across the second planar surface for receipt of a securement strap therethrough, so as to enable a down spout to be secured to the anchor member. The first planar surface and the second planar surface may be parallel to one another, or the first planar surface and the second planar surface may be non-parallel to one another. The pad may have an outer periphery of circular configuration, or the anchor pad may have an outer periphery of square configuration. The anchoring and support arrangement first planar surface may have an arrangement of engagement members extending thereon. The engagement members may be comprised of standoffs which are spaced across the first planar surface in a manner to engage the corner portions of the down spout therebetween. The second planar surface may have indentations thereon corresponding to the location of the standoffs on the first planar surface. The engagement portions may be in alignment with the channel on the second planar surface. The anchoring member may have a thickness of at least about ¾" to about 1". A down spout may be supported to a wall, by a plurality of anchoring members stacked upon one another. The anchoring members may be of different thicknesses. The adjacent anchoring members may be rotated about a central securement means so as to affect the skewness between the first planar surface of a first anchoring member and the back or second planar surface of a second anchoring member to which it is stacked thereagainst.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 1:
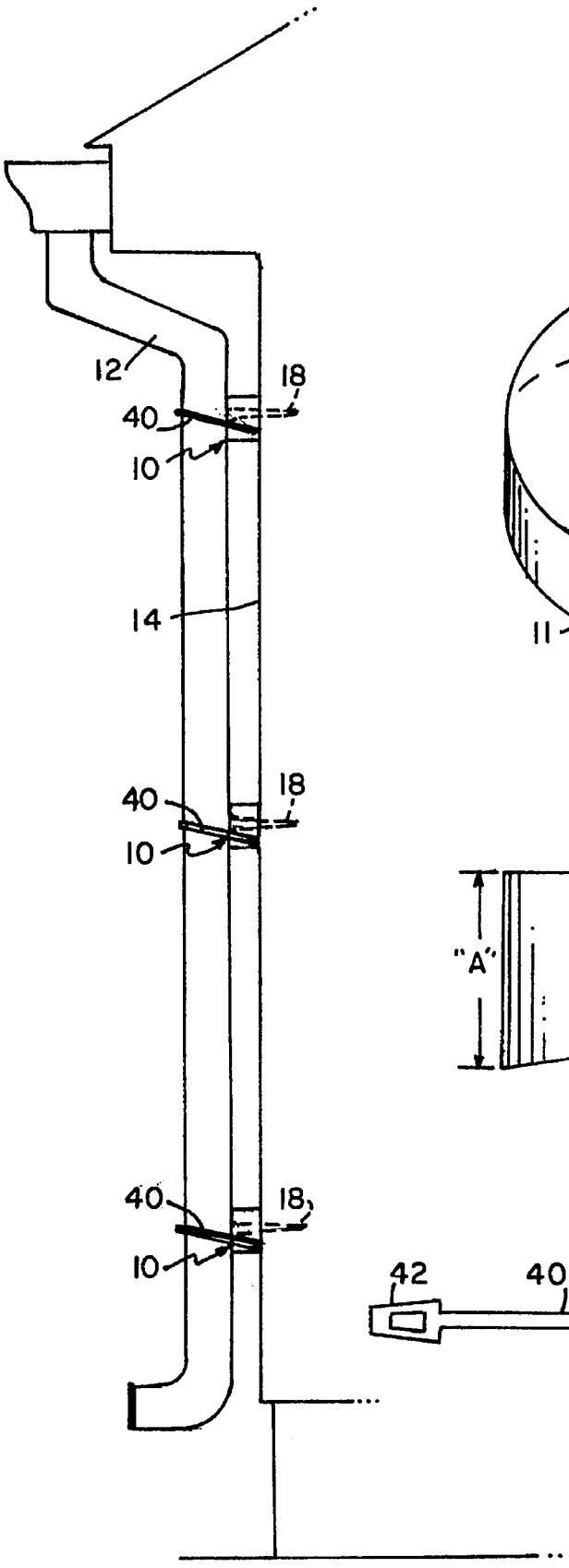
FIG. 1 is a side elevational view of a down spout attached to a gutter, and the gutter being arranged next to a roof of a house, the down spout being attached to the wall of that house.
Figure 2:
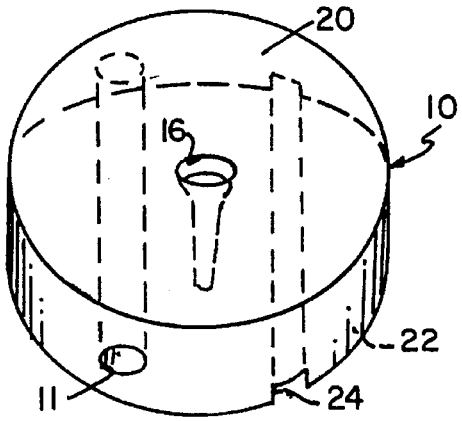
FIG. 2 is a perspective view of an anchor pad constructed according to the principles of the present invention.
Figure 3:
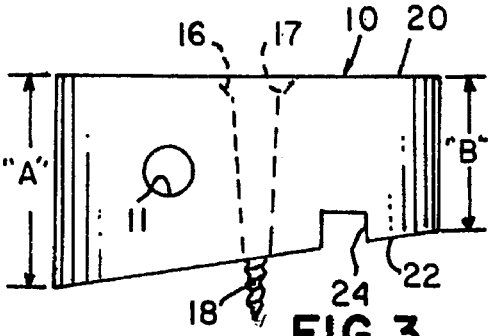
FIG. 3 is a side elevational view of an anchor pad constructed according to the principles of the present invention.

The present invention relates to a spacing pad arrangement 10 for supporting a down spout pipe 12 from a wall 14 of a building or structure. The spacer pad arrangement 10 is typically utilized between the down spout 12 and the wall 14 of the building so as to hold it spaced away from the building in an adjustably controlled manner. In a spacer arrangement 10 of the present invention in its preferred embodiment, comprises an injection molded disk shaped member approximately 2½ to 3 inches in diameter, as shown in FIG. 2, but may be about 1¼" thick and about 4" in diameter in commercial versions. The disk shaped anchor member 10 has a central bore 16 (which may be counter bored, as shown by dashed lines 17), through which a securement means 18 may be disposed, as shown in FIG. 1. Such securement means 18 may preferably comprise a galvanized dry wall screw, adhesive, a nail or like arrangements. The anchor pad 10 has a first or upper planar surface 20, and a second or lower planar surface 22. The second surface 22 in one embodiment, is parallel to the first planar surface 20. In a further embodiment, the second or lower surface 22 is in a non-parallel relationship with the first or upper surface 20, as shown in FIG. 3. In such a non-parallel arrangement, the thickness "A" of the anchor pad 10 on one diametrical side may be about ⅞ of an inch, and the thickness "B" of the other diametrical side is about 9/16 to about ¾ of an inch, thus reflecting a skewness of about 10 to 15 degrees. A channel 24 may be cut or molded into the lowermost or second planar surface 22 forming a kerf 24 of about ⅛ to 3/16 of an inch wide and deep. This kerf or channel 24, extends across the entire second planar surface 22 immediately adjacent the central bore 16 extending through the center of the anchor pad 10. The channel may also be comprised of a bore or hole 11, arranged across the pad 10, between the planar surfaces 20 and 22, parallel or skewed with respect thereto, as may be seen in FIG. 2.

Figure 5:
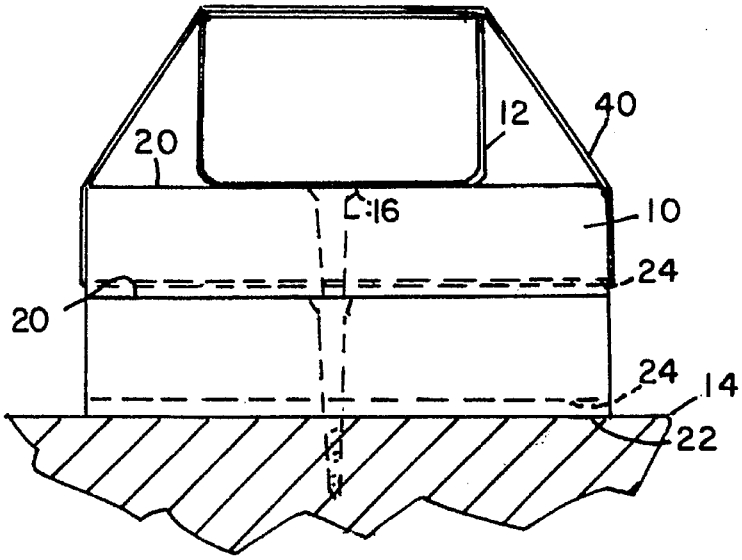
FIG. 5 is a side elevational view of a plurality of anchor pads stacked together to provide a multiple spacer arrangement between a wall and a down spout.
Figure 6:
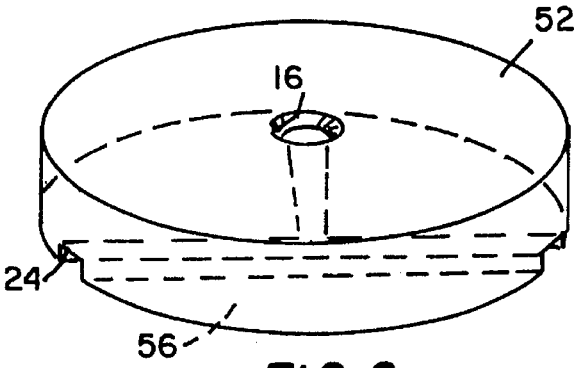
FIG. 6 is a perspective view of a further embodiment of the anchor pad shown in FIG. 2.
Figure 7:
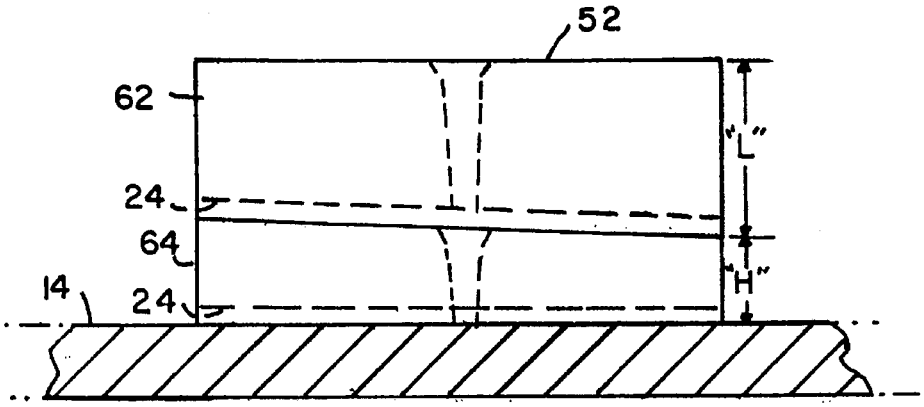
FIG. 7 is a side elevational view of the anchor pad shown in FIG. 6 in conjunction with a further anchor pad of a different thickness.

In operation, especially when dealing with uneven wall surfaces, or when moldings are encountered on a wall, several pads 10 of different thicknesses, i.e. from ½" to about 1" thick, may be stacked upon one another, as may be seen in FIGS. 5 and 7.

Figure 4:
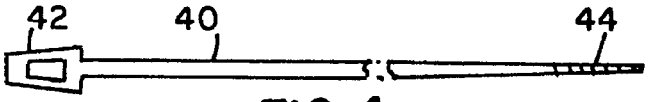
FIG. 4 is a plan view of a nylon tie strap, utilized with the anchor pad.

An elongated nylon tie strip 40, shown in FIG. 4, having a loop or receiving opening 42 at one end, and a barbed surface 44 at its other end, may be disposed through the channel or kerf 24 on the second or lowermost planar surface 22 of an anchoring pad 10. The nylon tie strap 40 may then be brought around any down spout 12 resting thereagainst. Such a down spout 12 may be anchored by securing them together by clinching one end through the barbed end 44 bending through the open looped end 42 to secure them together.

An assembly of two or more anchor pads 62 and 64 of different thicknesses "L" and "M", may be utilized to properly space the down spout 12 to a house. In the non-parallel planar face arrangement of an anchor pad, one (innermost) pad may be utilized to lie against a non-vertical or clapboard wall on which a down spout is to be placed.

By arranging a plurality of anchor pads, each having non-parallel planar surfaces, those anchor pads may be rotated with respect to one another, about their common bore axis 16, so as to properly provide and define an inside surface 22 which mates with a non vertical surface of a wall, while still providing an outermost first surface 20 onto which a down spout 12 may be secured.

Thus what has been shown is a unique arrangement for providing an anchoring means for securing a down spout to a house or wall, wherein that anchoring pad may be arranged in an adjustable manner to fit the non vertical surface of a wall with the vertical surface of a down spout.

I claim:

1. An anchoring and spacer pad standoff member for securing a pipe to a wall, comprising:

a cylindrically shaped member of plastic material having a first end for contact with said pipe and a spaced apart second end for contact with said wall defining the respective front and back ends of said anchor member;

a bore arranged longitudinally through said cylindrically shaped member from said first end to said spaced apart second end for receiving a securement member therethrough, for securing said cylindrically shaped member to a wall; and a channel arranged across said second end of said cylindrically shaped member for receipt of a securement strap therethrough, so as to enable a pipe to be secured to said first end of said anchor member, thereby encirclement of said strap around said pipe and along said channel of said cylindrically shaped member.

2. The anchoring and support arrangement as recited in claim 1, wherein said channel comprises a kerr or groove disposed in said second end, for the receipt of said strap therethrough.

3. The anchoring and support arrangement as recited in claim 1, wherein said channel comprises a hole or bore disposed across said block between said first and second ends, for the receipt of said strap therethrough.

4. The anchoring and support arrangement as recited in claim 1, wherein an adhesive is disposed on said second end of said cylindrically shaped member for adhesively attaching said cylindrically shaped member to said wall.

5. The anchoring and support arrangement as recited in claim 1, wherein said securement member comprises a threaded screw extending through said bore.

6. The anchoring and support arrangement as recited in claim 1, wherein said first end and said second end are parallel to one another.

7. The anchoring and support arrangement as recited claim 1, wherein said first end and said second end are non-parallel to one another.

8. The anchoring and support arrangement as recited in claim 1, wherein said anchoring member has a outer periphery comprised of a plurality of straight side portions.

9. The anchoring and support arrangement as recited in claim 1, wherein said anchoring member has a thickness of at least about ½ to about 1 inch.

10. The anchoring and support arrangement as recited in claim 9, including at least two said anchoring members, wherein a down spout may be supported to a wall by a plurality of anchoring members stacked upon one another.

11. The anchoring and support arrangement of claim 10, wherein said each of anchoring members are of different thicknesses.

12. The anchoring and support arrangement of claim 11, wherein said adjacent anchoring members may be rotated about a central securement means so as to affect the skewness between the first end of a first anchoring member and a second end of a second anchoring member disposed thereagainst.

13. An anchoring and spacer member for securing a down spout against a wall, said anchoring and spacer member being of cylindrical, disc-like shape, with a first end and a second end defining a down spout contacting plane and a wall contacting plane respectively;

a channel disposed across an arc segment of said second end;

a longitudinally directed bore through said cylindrically shaped member from said first end to said spaced apart second end through which a securement means may anchor said cylindrically shaped member to a wall; and a flexible strap adapted to lie in said channel and adapted to be wrapped about any down spout resting thereagainst, so as to hold said spout against said cylindrically shaped member, which cylindrically shaped member is adapted to be secured against said wall.

14. The anchoring and spacer member as recited in claim 13, having a second spacer member engaged therewith, so as to permit adjustability of the thickness of the distance a down spout is spaced from a wall.

15. The anchoring and spacer member as recited in claim 14, wherein said first and second ends each have corresponding mating and interlocking means arranged thereon.

* * * * *